US006995709B2

(12) United States Patent
Spittler

(10) Patent No.: US 6,995,709 B2
(45) Date of Patent: Feb. 7, 2006

(54) COMPACT STACKED QUARTER-WAVE CIRCULARLY POLARIZED SDS PATCH ANTENNA

(75) Inventor: Shelly D. Spittler, Redondo Beach, CA (US)

(73) Assignee: Raytheon Company, Waltham, MA (US)

( * ) Notice: Subject to any disclaimer, the term of this patent is extended or adjusted under 35 U.S.C. 154(b) by 43 days.

(21) Appl. No.: 10/223,164

(22) Filed: Aug. 19, 2002

(65) Prior Publication Data

US 2004/0032368 A1 Feb. 19, 2004

(51) Int. Cl.
*H01Q 1/38* (2006.01)

(52) U.S. Cl. ..... 343/700 MS

(58) Field of Classification Search ..... 343/700 MS, 343/829, 846

See application file for complete search history.

(56) References Cited

U.S. PATENT DOCUMENTS

| | | | | | |
|---|---|---|---|---|---|
| 4,070,676 | A | * | 1/1978 | Sanford | 343/700 MS |
| 4,162,499 | A | * | 7/1979 | Jones et al. | 343/700 MS |
| 4,783,661 | A | * | 11/1988 | Smith | 343/700 MS |
| 5,703,601 | A | * | 12/1997 | Nalbandian et al. | 343/700 MS |
| 5,917,450 | A | * | 6/1999 | Tsunekawa et al. | 343/700 MS |
| 5,986,606 | A | * | 11/1999 | Kossiavas et al. | 343/700 MS |

OTHER PUBLICATIONS

A. Hoorfar, A. Perrotta, "An Experimental Study of Microstrip Antennas on Very High Permittivity Ceramic Substrate and Very Small Ground Planes", Electronic Letters, vol. 49, No. 4, Apr. 2001, pp. 838-840.

K.F. Lee, Y.X. Guo, J.A. Hawkins, R. Chair, K.M. Luk, "Theory and experiment on microstrip patch antennas withshorting walls", IEE Proceedings—Microwave and Antennas Propagation, vol. 147, No. 6, Dec. 2000, pp. 521-525.

M. Lech, A. Mitchell, R. Waterhouse "Optimization of Broadband Microstrip Patch Antennas", Microwave Conference, 2000 Asia-Pacific, pp. 711-714.

L.L. Shafai, W.A. Chamma, M. Barakat, P.C. Strickland, G. Seguin "Dual-Band Dual-Polarized Perforated Microstrip Antennas for SAR Applications", IEEE Transactions on Antennas and Propagation, vol. 48, No. 1, Jan. 2000, pp. 58-66.

* cited by examiner

*Primary Examiner*—Tho Phan
(74) *Attorney, Agent, or Firm*—Leonard A. Alkov; Karl A. Vick

(57) ABSTRACT

A miniaturized, circularly polarized SDS patch antenna. Generally, the inventive antenna includes a ground plane over which a first patch is disposed. A short is provided between a first edge of the first patch and ground plane. A second patch is disposed over said first patch. A second short is provided between a first edge of the second patch and the first patch. The patch antenna of the illustrative embodiment further includes a first volume of dielectric disposed between the ground plane and the first patch. A second volume of dielectric is disposed between the first patch and the second patch. In the illustrative embodiment, the edges are shorted orthogonally. In an alternative embodiment, the shorted edges are in substantially parallel alignment. In yet another alternative embodiment, the antenna is designed for dual frequency operation. In the best mode, the area of the first patch is greater than the area of the second patch. In the illustrative application, high dielectric substrates and vertical shorting walls are combined to implement a compact circularly polarized patch antenna for use in low frequency applications. Two different high dielectric substrates are utilized to achieve a compact footprint with a stacked structure. The use of vertical shorting walls affords a substantial reduction in size while providing quarter-wave operation in both orthogonal directions. The coaxial feed position on the diagonal effects a rotation of the fields in a circular manner from the upper layer to lower layer.

17 Claims, 3 Drawing Sheets

FIG. 1
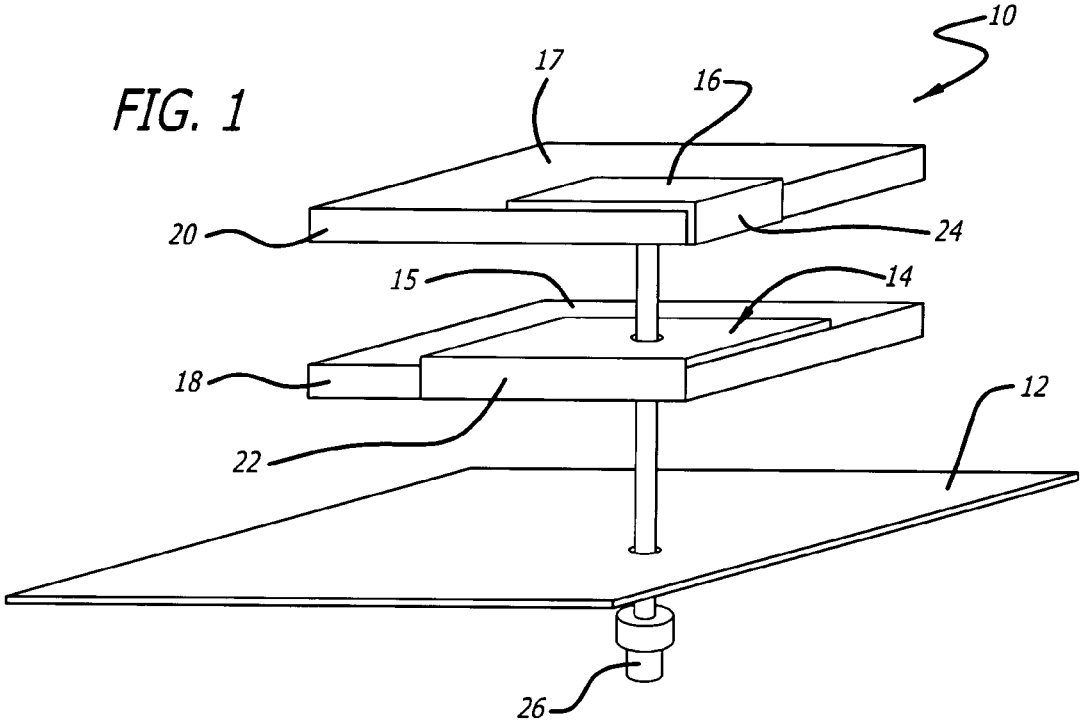
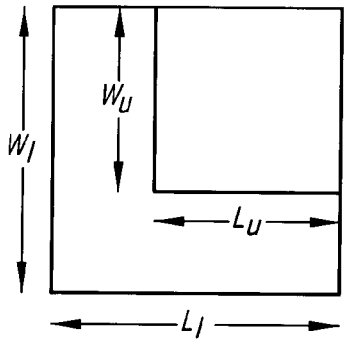
FIG. 2
FIG. 3
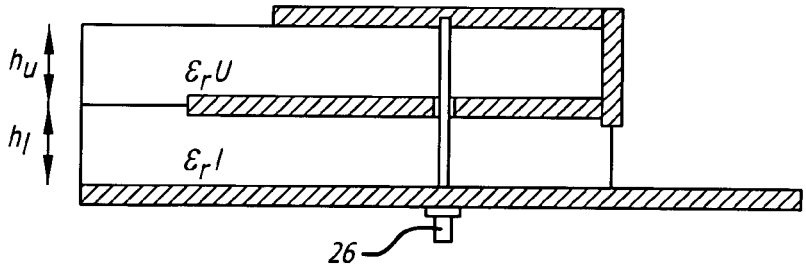

COMPACT STACKED QUARTER-WAVE CIRCULARLY POLARIZED SDS PATCH ANTENNA

BACKGROUND OF THE INVENTION

The present invention relates to antennas. More specifically, the present invention relates to patch antennas.

DESCRIPTION OF THE RELATED ART

The microstrip patch antenna has numerous advantages. Patch antennas are small, low profile, lightweight antennas that are mechanically robust, simple to manufacture and inexpensive. Accordingly, the patch antenna has many applications in current and future mobile communication systems which require very small, low cost antennas. Patch antennas easily meet these requirements at high frequencies, however, design and fabrication of physically small patch antennas for low frequency applications is challenging due to the relatively large resonant length of the patch antenna.

GPS and wireless systems often require not only compact antennas but also antennas that exhibit other key features such as circularly polarized operation. Hence, a miniaturization of circularly polarized patch antennas has been needed in order to support future communication systems for both high and low frequency operation.

The prior art has included the use of high dielectric substrate for miniaturization. In some cases shorting walls and shorting pins have been used to reduce the length of the patch by 50%. Patch antennas have been used in a stacked structure with both layers exhibiting similar polarization at both frequencies to create a dual frequency antenna or an antenna with a greater bandwidth. Others working in the art have been able to miniaturize linearly polarized patch antennas and dual frequency patch antennas. However, current and future applications require compact circularly polarized antennas inasmuch as circularly polarized antennas are capable of receiving signals of any polarization, i.e., vertical, horizontal or circular. For this purpose, orthogonal polarizations are needed. However, to date, orthogonal polarizations have been difficult to achieve with the current miniaturization techniques.

Hence, a need remains in the art for an inexpensive, miniaturized, circularly polarized patch antenna and method of making same adapted for use at a wide range of frequencies.

SUMMARY OF THE INVENTION

The need in the art is addressed by the antenna design of the present invention. Generally, the inventive antenna includes a ground plane over which a first patch is disposed. A short is provided between a first edge of the first patch and ground plane. A second patch is disposed over said first patch. A second short is provided between a first edge of the second patch and the first patch.

In the illustrative embodiment, the antenna is implemented as a miniaturized, circularly polarized patch antenna. The patch antenna of the illustrative embodiment further includes a first volume of dielectric disposed between the ground plane and the first patch. A second volume of dielectric is disposed between the first patch and the second patch.

In the illustrative embodiment, the edges are shorted orthogonally. In an alternative embodiment, the shorted edges are in substantially parallel alignment. In yet another alternative embodiment, the antenna is designed for dual frequency operation. In the best mode, the area of the first patch is greater than the area of the second patch.

In the illustrative application, high dielectric substrates and vertical shorting walls are combined to implement a compact circularly polarized patch antenna for use in low frequency applications. Two different high dielectric substrates are utilized to achieve a compact footprint with a stacked structure. The use of vertical shorting walls affords a substantial reduction in size while providing quarter-wave operation in both orthogonal directions. The coaxial feed position on the diagonal effects a rotation of the fields in a circular manner from the upper layer to lower layer.

BRIEF DESCRIPTION OF THE DRAWINGS

FIG. 1 is a side elevational view of an illustrative embodiment of the patch antenna of the present invention in disassembled relation.

FIG. 2 is a top plan view of the illustrative embodiment of the patch antenna of the present invention.

FIG. 3 is a sectional side view of the illustrative embodiment of the patch antenna of the present invention.

FIG. 4(*b*) illustrates that if the patch is shorted in both dimensions, due to image theory, the shorted patch should be functionally equivalent to the original patch, including all performance characteristics, with only 25 percent of the original patch size.

FIG. 5(*b*) shows a series diagrams illustrated of an electric field distribution on the surface of the lower dielectric substrate of the illustrated embodiment of the patch antenna of the present invention as a function of phase.

DESCRIPTION OF THE INVENTION

Figure 4A:
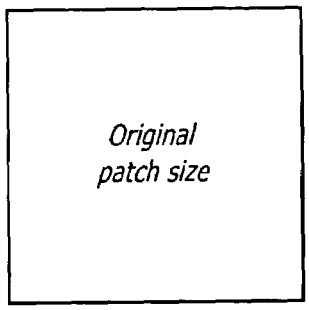
PRIOR ART FIG. 4(a)
FIG. 4(*a*) is a top plan view of a patch implemented in accordance with conventional teachings.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

FIG. 1 is a side elevational view of an illustrative embodiment of the patch antenna of the present invention in disassembled relation.

FIG. 2 is a top plan view of the illustrative embodiment of the patch antenna of the present invention.

FIG. 3 is a sectional side view of the illustrative embodiment of the patch antenna of the present invention. As illustrated in FIGS. 1–3, the inventive antenna 10 (hereinafter the "SDS" patch antenna) includes a conductive ground plane 12 over which first and second conductive patches 14 and 16 are disposed in a multi-layer stack configuration. The first and second patches 14 and 16 are mounted on first and second substrates of dielectric material 18 and 20 respectively. The first and second substrates of dielectric material may be of any construction suitable for a given application including, without limitation, air and foam. For the illustrative application, substrates with dielectric constants up to 20 were found to be most suitable, however, substrates with other dielectric constants may be used as well. In general, the height of the two substrates is chosen to reduce the input impedance and increase the bandwidth.

In the illustrative embodiment, the dielectric constant of the substrate of the upper patch is higher than that of the lower patch allowing the upper patch to be smaller than the lower patch, effectively separating the radiating edges and resulting in less coupling therebetween. (See FIGS. 2 and 3.) Further, the use of two different high dielectric substrates facilitates a compact footprint with a stacked structure.

This may be achieved by choosing an upper substrate 20 with a higher dielectric constant than that of the lower substrate 18. Thus, for the illustrative embodiment:

$$L_u = W_u = \lambda_u/4 \quad (1)$$

$$L_l = W_l = \lambda_l/4 \quad (2)$$

$$\in_r u > \in_r l \quad (4)$$

$$h_u > h_l \quad (3)$$

where '$L_u$' is the length of the upper patch, '$W_u$' is the width of the upper patch, '$\lambda_u$' is the wavelength of the signal in the upper patch dielectric, '$L_l$' is the length of the lower patch, '$W_l$' is the width of the lower patch, '$\lambda_l$' is the wavelength of the signal in the lower patch dielectric, '$\in_r u$' is the dielectric constant of the upper substrate, '$\in_r l$' is the dielectric constant of the lower subtrate, '$h_u$' is the thickness of the upper substrate, and '$h_l$' is the thickness of the lower substrate. The upper substrate height is increased in order to offset the narrow bandwidth resulting from an increase in the permittivity thereof.

In accordance with present teachings, the first patch 14 is shorted, at at least one frequency, to the ground plane 12 by, in the illustrative embodiment, a first shorting wall 22 and the second patch 16 is shorted, at at least one frequency, to the first patch 14 by, in the illustrative embodiment, a second shorting wall 24. Note that in the embodiment of FIG. 1, the shorting walls 22 and 24 are connected to orthogonally oriented edges of the patches 14 in 16. That is, the upper patch is connected to the lower patch via a vertical shorting wall along the length dimension thereof and the lower patch is connected to the ground plane of the structure via a vertical shorting wall along the width dimension thereof. The orthogonal shorting walls ensure that the two patches are linearly polarized in orthogonal directions while allowing for a significant reduction in patch size (e.g., 75 percent). This is illustrated in FIGS. 4(*a*) and (*b*) below.

Figure 4B:
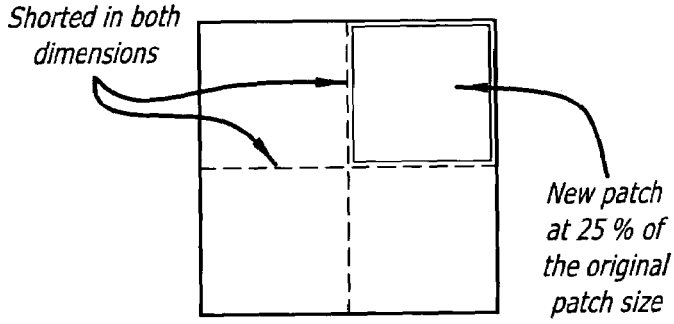

FIG. 4(*a*) is a top plan view of a patch implemented in accordance with conventional teachings. FIG. 4(*b*) illustrates that if the patch is shorted in both dimensions, due to image theory, the shorted patch should be functionally equivalent to the original patch, including all performance characteristics, with only 25 percent of the original patch size. Unfortunately, as is well known in the art, the use of a shorting wall imposes a significant constraint on the antenna inasmuch as a shorted patch is only able to transmit or receive electromagnetic energy from an edge diametrically opposed to the shorted edge. However, in accordance with the present teachings, this shortcoming is addressed by the use of two or more patches. This is illustrated with respect to FIG. 5 below.

Figures 5A, 5B:
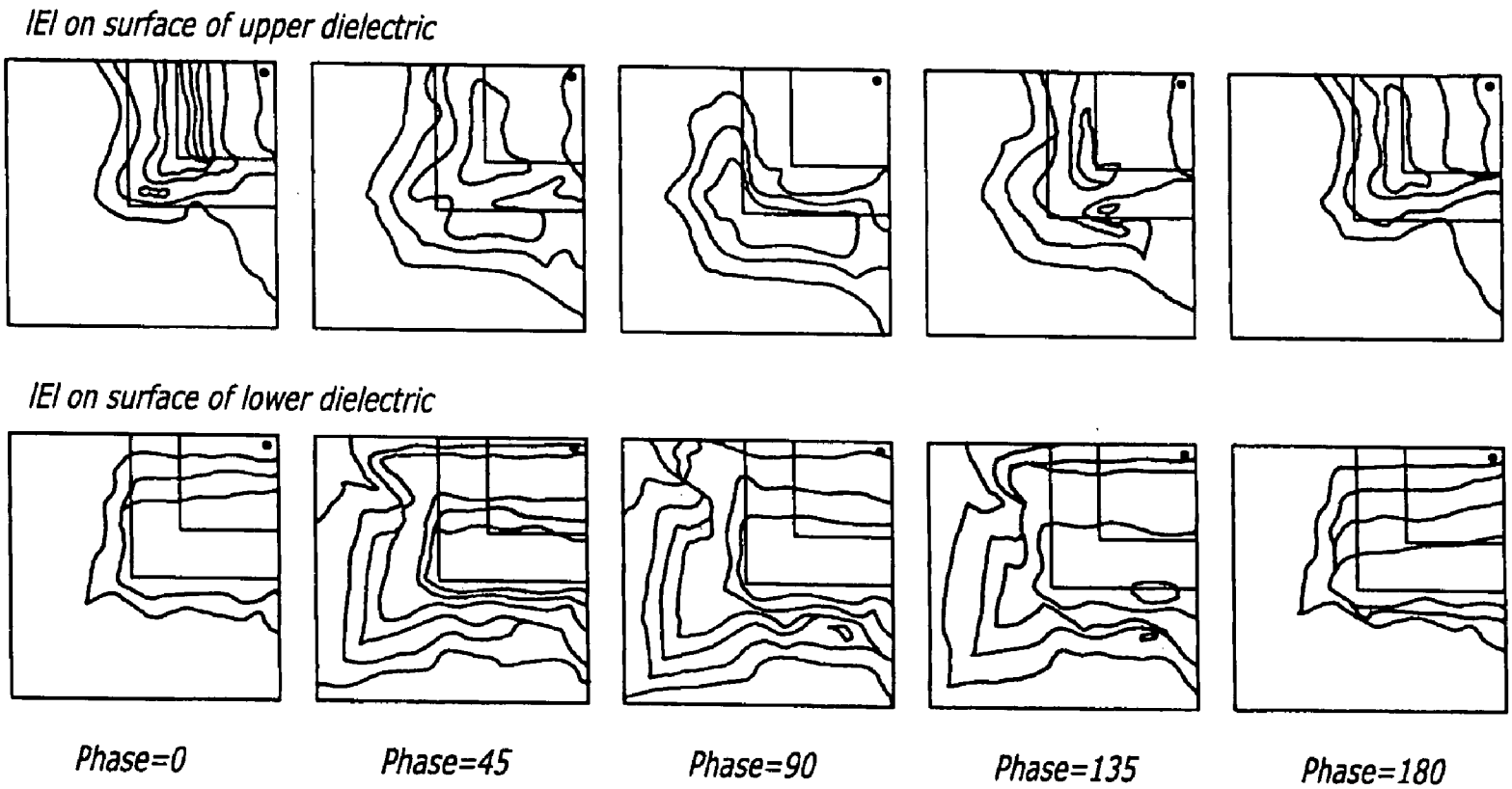
FIG. 5(*a*) shows a series of diagrams illustrative of an electric field distribution on the surface of the upper dielectric substrate of the illustrative embodiment of the patch antenna of the present invention as a function of phase.

FIG. 5 shows the rotation of electric fields from the upper patch to the lower patch to produce circular polarization in accordance with the teachings of the present invention.

FIG. 5(*a*) shows a series of diagrams illustrative of an electric field distribution on the surface of the upper dielectric substrate 20 of the illustrative embodiment of the patch antenna of the present invention as a function of phase.

FIG. 5(*b*) shows a series of diagrams illustrative of an electric field distribution on the surface of the lower dielectric substrate 18 of the illustrative embodiment of the patch antenna of the present invention as a function of phase.

As illustrated in FIG. 5(*a*), the shorting wall 24 at the right side of the upper patch 16 constrains the electric field radiated by the patch 16 to the left edge 17 thereof. Substantially no energy is radiated by the upper patch 16 at a phase angle of 90 degrees.

FIG. 5(*b*) illustrates that the placement of a shorting wall at the top edge of the lower patch 14 constrains the electric field generated by the patch 14 to the bottom edge 15 thereof. Substantially no energy is radiated by the lower patch 14 at a phase angle of 0 degrees or a phase angle of 180 degrees. Those skilled in the art will appreciate that in tandem, the upper and lower patches, 16 and 14 respectively, cooperate to radiate electric energy at any phase angle and at any polarization. Consequently, the inventive antenna operates as a circularly polarized antenna.

The shorting walls need not be oriented in orthogonal relation. As an alternative, the shorting walls may be on the same side of each patch such that a parallel relation exists therebetween. In this configuration, with a single polarization, a dual frequency mode of operation is enabled. As yet another alternative, with the shorting walls on the same side, at a single frequency, an increased bandwidth may result.

While shorting walls are shown in the illustrative embodiment, those skilled in the art will appreciate that the patches may be shorted using shorting pins, metal vias, or other arrangements known in the art without departing from the scope of the present teachings.

The small size of the patches afforded by the use of shorting walls allows for quarter-wavelength operation. See equations [1] and [2] above. Nonetheless, those skilled in the art will appreciate that the present teachings may be extended to patches of other shapes and sizes without departing from the scope of the invention. Similarly, the height of the two substrates and their ratios may be altered without departing from the scope of the invention.

As illustrated in FIGS. 1–3, the upper patch 16 is fed, in the illustrative embodiment, on the diagonal by a coaxial feed 26 which extends through the ground plane 12, the first to electric substrate 18, the first patch 14, and the second dielectric substrate 20. The diagonal feeding position excites both polarizations and results in the electric fields circulating from the upper to lower patch as discussed above in connection with FIG. 5. Note that the coaxial feed 26 makes no contact with the lower patch 14. Notwithstanding the fact that a coaxial feed is shown, those skilled in the art will appreciate that other feed arrangements, such as aperture coupling, microstrip, stripline and etc., may be used as well without departing from the scope of the present teachings.

When the two-layered patches are designed for the same frequency and polarization, an increased bandwidth may be obtained. In the illustrative embodiment, the two patches are designed to operate at the same frequency with orthogonal polarizations. In this case, the resonant frequencies of the $TM_{10}$ and $TM_{01}$, modes are designed to be close together. (See FIG. 6.)

Figure 6:
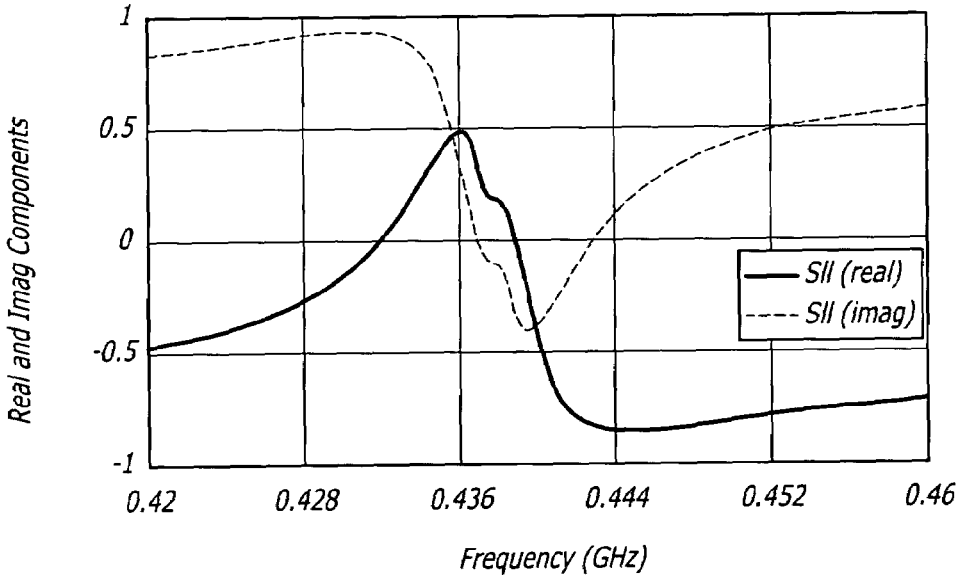
FIG. 6 is a graph showing the real and imaginary components of the return loss of a signal transmitted by the patch antenna implemented in accordance with the teachings of the present invention.

FIG. 6 is a graph showing the real and imaginary components of the return loss of a signal transmitted by the patch antenna implemented in accordance with the teachings of the present invention. The two peaks in the real component shown in FIG. 6 correspond to the resonant frequencies of the $TM_{10}$ and $TM_{01}$, modes. The place where the imaginary component crosses zero corresponds to the resonant frequency of the antenna. In the best mode, both layers are resonant at nearly the same frequency.

As mentioned above, when fed with a diagonally positioned coax, circular polarization can be achieved in this compact structure. However, the invention is not limited to this mode of operation. That is, dual frequency operation may be achieved by designing the antenna so that the $TM_{10}$ and $TM_{01}$ resonant frequencies are further apart. Thus, in accordance with the present teachings, two miniaturization techniques, the use of high dielectric substrate and vertical shorting walls, are combined to implement a compact circularly polarized patch antenna well suited for use in low frequency (400–500 MHz) applications. However, those skilled in the art will appreciate that the present invention is not limited thereto. That is, the present teachings may be used at other frequency ranges without departing from the scope of the present teachings. Two different high dielectric substrates may be utilized to achieve dual radiating frequency operation with a compact footprint with a stacked structure. Vertical shorting walls are incorporated into the structure to provide quarter-wave operation in both orthogonal directions. The coaxial feed position on the diagonal provides the rotation of the fields in a circular manner from the upper to lower layer. Those skilled in art will appreciate that with proper selection of the dielectric substrate ratio and height, such to reduce the coupling between radiating edges, a very good axial ratio can be achieved.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed:

1. An antenna comprising:

a ground plane;

a first patch disposed over said ground plane;

a second patch disposed over said first patch; and means for radiating a circularly polarized signal from said antenna, said means for radiating including:

a first shorting wall between an edge parallel to a radiating first edge of said first patch and said ground plane and a second shorting wall between an edge parallel to a radiating first edge of said second patch and said first patch, said first edge of said first patch and said first edge of said second patch being disposed in substantially orthogonal relation.

2. The invention of claim 1 further including a first volume of dielectric disposed between said ground plane and said first patch.

3. The invention of claim 2 further including a second volume of dielectric disposed between said first patch and said second patch.

4. The invention of claim 1 further including means for feeding an input signal to said second patch.

5. The invention of claim 1 wherein the area of said first patch is greater than the area of said second patch.

6. The invention of claim 5 further including a first volume of dielectric disposed between said ground plane and said first patch.

7. The invention of claim 6 further including a second volume of dielectric disposed between said first patch and said second patch.

8. The invention of claim 7 wherein the dielectric constant of said second dielectric is greater than the dielectric constant of said first dielectric.

9. The invention of claim 1 wherein the length or width of said first patch is equal to one-quarter of the wavelength of a signal fed thereto.

10. The invention of claim 1 wherein the length or width of said second patch is equal to one-quarter of the wavelength of a signal fed thereto.

11. A quarter-wave antenna for circularly polarized signals comprising:

a ground plane;

a first patch disposed over said ground plane;

a first shorting wall connected between an edge parallel to a radiating first edge of said first patch and said ground plane;

a first layer of dielectric disposed between said ground plane and said first patch;

a second patch disposed over said first patch;

a second shorting wall connected between an edge parallel to a radiating first edge of said second patch and said first patch, said first edge of said first patch and said first edge of said second patch being disposed in substantially orthogonal relation; and a second layer of dielectric disposed between said first patch and said second patch.

12. The invention of claim 11 further including means for feeding an input signal to said second patch.

13. The invention of claim 11 wherein the area of said first patch is greater than the area of said second patch.

14. The invention of claim 11 wherein the dielectric constant of said second layer of dielectric is greater than the dielectric constant of said first layer of dielectric.

15. The invention of claim 11 wherein the length or width of said first patch is equal to one-quarter of the wavelength of a signal fed thereto.

16. The invention of claim 11 wherein the length or width of said second patch is equal to one-quarter of the wavelength of a signal fed thereto.

17. A method for transmitting or receiving a circularly polarized signal including the steps of:

providing a ground plane;

providing a first patch disposed over said ground plane;

creating a short at least one frequency between an edge parallel to a radiating first edge of said first patch and said ground plane;

providing a second patch disposed over said first patch;

creating a short at least one frequency between an edge parallel to a radiating first edge of said second patch and said first patch, said first edge of said first patch and said first edge of said second patch being disposed in substantially orthogonal relation; and feeding an input signal to or taking an output signal from said antenna.

* * * * *